US009357627B2

(12) United States Patent
Antsiferov et al.

(10) Patent No.: US 9,357,627 B2
(45) Date of Patent: May 31, 2016

(54) LIGHT SOURCE WITH LASER PUMPING AND METHOD FOR GENERATING RADIATION

(71) Applicants: Pavel Stanislavovich Antsiferov, Moscow (RU); Konstantin Nikolaevich Koshelev, Moscow (RU); Vladimir Mikhailovich Krivtsun, Moscow (RU); Aleksandr Andreevich Lash, Moscow (RU)

(72) Inventors: Pavel Stanislavovich Antsiferov, Moscow (RU); Konstantin Nikolaevich Koshelev, Moscow (RU); Vladimir Mikhailovich Krivtsun, Moscow (RU); Aleksandr Andreevich Lash, Moscow (RU)

(73) Assignee: OOO "RnD-ISAN", Troitsk, Moscow (RU)

( * ) Notice: Subject to any disclaimer, the term of this patent is extended or adjusted under 35 U.S.C. 154(b) by 0 days.

(21) Appl. No.: 14/782,644

(22) PCT Filed: Apr. 8, 2014

(86) PCT No.: PCT/RU2014/000257

§ 371 (c)(1),
(2) Date: Oct. 6, 2015

(87) PCT Pub. No.: WO2014/168519

PCT Pub. Date: Oct. 16, 2014

(65) Prior Publication Data

US 2016/0044774 A1 Feb. 11, 2016

(30) Foreign Application Priority Data

Apr. 11, 2013 (RU) ..... 2013116408

(51) Int. Cl.

| | |
|---|---|
| ***H01J 17/04*** | (2012.01) |
| ***H05H 1/24*** | (2006.01) |
| ***H01J 65/04*** | (2006.01) |
| ***H01J 61/02*** | (2006.01) |
| ***H01J 61/52*** | (2006.01) |
| ***H01J 61/54*** | (2006.01) |
| ***H01J 61/76*** | (2006.01) |
| ***H05H 1/48*** | (2006.01) |

(52) U.S. Cl.

CPC ..... *H05H 1/24* (2013.01); *H01J 61/025* (2013.01); *H01J 61/523* (2013.01); *H01J 61/54* (2013.01); *H01J 61/545* (2013.01); *H01J 61/76* (2013.01); *H01J 65/04* (2013.01); *H05H 1/48* (2013.01)

(58) Field of Classification Search

CPC ..... H01J 61/76; H01J 61/025
USPC ..... 313/631, 634
See application file for complete search history.

(56) References Cited

U.S. PATENT DOCUMENTS

2011/0181191 A1 7/2011 Smith et al.
2013/0001438 A1 1/2013 Bezel et al.

FOREIGN PATENT DOCUMENTS

JP 2011119200 A 6/2011

*Primary Examiner* — Vip Patel
(74) *Attorney, Agent, or Firm* — Nadya Reingand

(57) ABSTRACT

Invention provides extending the functional possibilities of a light source with laser pumping due to increasing its spatial and energy stability brightness and the reliability under long-term operation whilst ensuring compactness of the device. The result is achieved due to the fact that a focused laser beam is directed into a region of radiating plasma from the bottom upwards: from the lower wall of a chamber to an upper wall of the chamber which is opposite said lower wall, and the region of radiating plasma is arranged close to the upper wall of the chamber. In embodiments of the invention, the focused laser beam is directed along a vertical axis of symmetry of the walls of the chamber, the region of radiating plasma is produced at an optimally small distance away from the upper wall of the chamber and determined radiation power is maintained via an automated control system.

20 Claims, 5 Drawing Sheets

LIGHT SOURCE WITH LASER PUMPING AND METHOD FOR GENERATING RADIATION

CROSS-REFERENCE TO RELATED APPLICATIONS

Current patent application is a National stage application from PCT application No. PCT/RU2014/000257 filed on Apr. 8, 2014 which claims priority to the Russian patent application No. 2013116408 filed on Apr. 11, 2013.

FIELD OF THE INVENTION

The invention relates to a device of light sources with laser pumping and to methods for generating radiation with a high level of brightness in the UV and visible spectral ranges.

PRIOR ART

Optical discharge may be used as a light source with a high level of brightness since the temperature of the plasma in the optical discharge is significantly greater than in others—15000-20000 K, whereas an arc is usually between 7000-8000 K, HF discharge—9000-10000 K. Optical discharge plasma in various gases, in particular, in xenon Xe, created by beam of a continuous wave laser at gas pressures of 10-20 atm., is one of the highest-brightness sources of continuous radiation in the wide spectral range of 170-880 nm. As a highly efficient plasma-forming fuel, mercury vapors may be used, including mixtures with inert gases, as well as vapors of other metals, and various gas mixtures, including the ones containing halogens. Compared to arc lamps, these sources have greater lifetime. The high spectral brightness of light sources with laser pumping, around 104 W/m2/nm/sr at the radiation power level of several watts, makes them preferable for many applications.

These high-brightness light sources can be used for spectrochemical analysis, spectral micronanalysis of bioobjects in biology and medicine, in microcapillary liquid chromatography, for inspection of the optical lithography process. These can also be used for various projection systems, in microscopy, spectrphotometry, and for other purposes. Parameters of the light source, for example, wavelength, power level, and radiation brightness, vary depending on the field of application.

To obtain the optical discharge plasma, various types of lasers with laser radiation in the wavelength range from 0.26 um (4th harmonic of Nd:YAG laser) to 10.6 um ($CO_2$ laser radiation), see for example, G. V. Ostrovskaya, A. N. Zaidel' "Laser spark in gases" Soviet Physics-Uspekhi, 16 834-855, 1974. At prolonged or continuous optical discharge, for starting plasma ignition in the chamber, filled with high-pressure gas, various methods are used, including, an auxiliary laser, whose parameters differ from the laser parameters for prolonged input of laser radiation power into the plasma, see for example, B. F. Mul'chenko, Yu. P. Raizer, V. A. Epshtein Soviet Physics JETP V. 32, Number 6 June, 1971 High-pressure laser spark ignited by an external plasma source. A drawback of the specified device, and methods, created over 40 years ago, was insufficiently high operating stability in long-term continuous mode with high effectiveness.

This drawback is absent in the light source with laser pumping, containing chamber with gas, optical element for focusing laser beam, forming in the chamber a region of plasma with high-brightness broadband radiation and providing continuous input of laser radiation power into the plasma, U.S. Pat. No. 8,309,943, published 13 Nov. 2012. In the method of generating radiation for starting plasma ignition, two probe electrodes are used, placed on the axis of the quartz chamber, the laser beam is focused into the center of the chamber, in the gap between the two electrodes, wherein the axis of the laser beam is directed along the X axis, and the axes of the electrodes, directed along the Y axis, are positioned in the horizontal XY plane, FIG. 15.

This light source is characterized by high efficiency, reliability, lifetime. It is provided with an effective optical system for collecting plasma radiation, equipped with a blocker of the passing through the plasma and unabsorbed laser radiation.

However, the geometry of the light source determined by the direction of the laser beam and the position of the region of radiating plasma, created in the discharge gap for starting ignition of the plasma, is not optimal for achieving high stability output characteristics of a high brightness light source. This is mostly related to the negative effect of convective streams of gas in the chamber on the region of radiating plasma and, correspondingly, on the energy and spatial stability of the light source with laser pumping.

Partly devoid of this drawback, the light source wherein the starting ignition of plasma in the chamber and the formation, in continuous mode, of the plasma region with high brightness radiation, is carried out using beams of two different lasers, application US20130001438, published 3 Jan. 2013. By selecting the parameters of two laser beams, the invention can optimize plasma parameters to increase radiation brightness.

Although this device and method, in principle, make it possible to vary, within sufficiently wide limits, the geometry of the high brightness light source, the optimal configuration for minimizing the negative effect of convective streams of gas in the chamber on the output parameters of the radiation has not been overcome. This leads to the possibility of sufficiently high energy and spatial instability of the light source caused by convection of gas in the chamber and limiting the range of its applications.

The drawback is partly absent in the light source with laser pumping, see US patent application 20110181191, published 27 Jul. 2011, including a chamber, containing gas; laser, generating the laser beam; optical element, focusing the laser beam; region of radiating plasma, created in the chamber along the axis of the focused laser beam; and optical system for collecting plasma radiation, forming a beam of plasma radiation. When implementing this method of generating radiation the plasma is ignited in the gas-filled chamber and, in continuous mode, the laser beam is focused in the plasma region. Starting ignition and then maintaining the plasma of an optical discharge is implemented in the center of the chamber between two auxiliary electrodes. A feedback device is equipped in order to reduce instability of the light source output parameters. The feedback device performs measurements of parameters of parts of the radiation, digitizes the data, determines deviation from the set value and on this basis generates the laser control signal to reduce instability in the light source.

This light source is characterized by high brightness and relatively high stability of output characteristics by using the feedback device.

However, the geometry of the light source is not optimal and does not reduce the instability or noise, resulting from intense turbulent streams of gas in the chamber due to heat convection in the gravity field. This reduces the possibility of effectively suppressing instability of output parameters of the light source with laser pumping, even using the feedback device.

SUMMARY

The object of the invention is to create a highly stable compact light source with very high brightness and long lifetime and a method for generating radiation.

The technical result of the invention is increased spatial and energy stability of the high-brightness light source with laser pumping and increased reliability of operation.

Implementing this goal is possible using the proposed light source with laser pumping, comprising a chamber, containing gas; laser, generating a laser beam; optical element, focusing the laser beam; region of radiating plasma, created in the chamber along the axis of the focused laser beam; and the optical system for collecting plasma radiation, forming a beam of plasma radiation, wherein a focused laser beam is directed into the region of radiating plasma from the bottom upwards: from the lower wall of a chamber to an opposite upper wall of the chamber, and the region of radiating plasma is arranged at a distance from the upper wall of the chamber less than the distance from the region of radiating plasma to the lower wall of the chamber.

Preferably, the axis of the focused laser beam is directed upwards vertically or close to vertical.

Particularly, the region of radiating plasma is positioned at a minimal distance from the top wall of the chamber to avoid causing significant negative effects on the lifetime of the light source with laser pumping.

Preferably, the chamber walls have a plane of symmetry with an axis of symmetry of the walls of a chamber cross section in symmetry plain, the chamber is positioned in such a way that the axis of symmetry of the cross section of the walls of the chamber is vertical or close to vertical.

Preferably, the axis of the focused laser beam is directed along the axis of symmetry of the cross section of the walls of the chamber, or close to the axis of symmetry of the cross section of the chamber walls.

Preferably, the region of radiating plasma is positioned along the axis of symmetry of the cross section of the walls of the chamber.

Particularly, the axis of the focused laser beam forms an angle to the vertical not to exceed 45 degrees.

Furthermore, from the lower side of the chamber an axis of the laser beam, generated by the laser, has a direction close to horizontal, wherein on the axis of the laser beam an optical element is installed, directing the laser beam in a direction of the chamber.

In particular, the light source with laser pumping contains an optical element, directing the axis of the beam of plasma radiation along the horizontal line, or close to horizontally.

Furthermore, the numerical aperture $NA_1$ of the focused laser beam and the laser power are selected such that the region of radiating plasma is alongated along the axis of the focused laser beam, having a small, ranging from 0.1 to 0.5, aspect ratio d/l of a transverse d and a longitudinal l dimensions of the region of radiating plasma, a brightness of plasma radiation along the axis of the focused laser beam is close to maximum attainable for the given laser power, a numerical aperture $NA_2$ of a divergent laser beam passing through the region of radiating plasma from an upper side of the chamber is less than the numerical aperture $NA_1$ of the focused laser beam from the lower side of the chamber: $NA_2<NA_1$, wherein the optical system for collecting plasma radiation is positioned on the upper side of the chamber, and an output of plasma radiation onto the optical system for collecting plasma radiation is carried out by divergent beam of plasma radiation with an apex in the region of radiating plasma.

In particular, the divergent beam of plasma radiation with the numerical aperture NA, entering onto the optical system for collecting plasma radiation, does not intersect the divergent laser beam from the upper side of the chamber that has passed through the region of radiating plasma; in accordance with this an angle between the axis of the divergent beam of plasma radiation and the axis of the focused laser beam is greater than (arctg NA+arctg $NA_2$).

In particular, the axis of the divergent beam of plasma radiation, outputting onto the optical system for collecting plasma radiation, is directed primarily along the axis of the focused laser beam.

Additionally, installed from the lower side of the chamber, a concave spherical mirror or modified concave spherical mirror with a center in the region of the radiating plasma, having an opening, in particular, optical opening, for an input of the focused laser beam in the region of radiating plasma.

In particular, two electrodes for starting plasma ignition are inserted in the chamber having a discharge gap between them.

Furthermore, two pin electrodes for starting plasma ignition are inserted in the chamber, the electrodes having horizontal longitudinal axes.

Additionally, two electrodes for starting plasma ignition are placed in the chamber, with a discharge gap between them, the region of radiating plasma is positioned outside the discharge gap, wherein the optical element, focusing laser beam, implemented with the function for short-term displacements of a focus of the laser beam in the discharge gap for duration of starting plasma ignition.

In particular, the light source with laser pumping is equipped with a fan.

Additionally, the light source with laser pumping has at least one nozzle, connected to an outlet of a mini compressor.

In particular, the chamber is located in a sealed housing with protective gas, in particular, other than air.

In particular, the system for circulating the protective gas comprises at least one nozzle providing cooling of the top wall of the chamber using a directed flow of the protective gas, a mini-compressor and a heat exchanger; wherein an outlet of the mini compressor is connected to the nozzle through the heat exchanger, and an inlet to the mini compressor is connected to the sealed housing.

In particular, an automated control system with a negative feedback is introduced and has the function for maintaining the specified power of the light source with laser pumping, including a power meter for plasma radiation beam and a controller processing power meter measurement data of the plasma radiation beam and controlling an output power of the laser.

In the method for generating radiation, a focused laser beam is directed from bottom upwards: from the lower chamber wall to an opposite top wall of the chamber, temporarily providing focusing of the laser beam in the discharge gap between the electrodes for starting plasma ignition, plasma is ignited and the focus of the laser is shifted from bottom upwards and using the focused laser beam in continuous mode forms the region of radiating plasma outside the discharge gap near the top wall of the chamber.

In particular, the focused laser beam is directed in the chamber along a vertical axis of symmetry of the cross section of the walls of the chamber and the region of radiating plasma is produced at the smallest optimal distance away from the upper chamber wall, wherein the proximity of the plasma to the upper chamber wall does not have a significant effect on the service life of the light source.

Furthermore, the chamber is cooled by protective gas, directed towards the upper chamber wall.

In particular, a required radiation power value for the light source with laser pumping is preliminary set and during long-term operation, with an aid of an automated control system, a set radiated power for the light source with laser pumping is maintained.

These objects, features, and advantages of the invention, as well as the invention itself will be more understood from the following description of the embodiments of the invention, illustrated in the accompanying drawings.

BRIEF DESCRIPTION OF THE DRAWINGS

The technical essence and principle of operation of the proposed device are illustrated in the drawings, in which.

Shown on FIG. 1, FIG. 2, FIG. 3, FIG. 4, the schematic view of the light source in various embodiments of the present invention.

DETAILED DESCRIPTION OF THE PREFERRED EMBODIMENTS

This description is intended to illustrate implementation of the invention and not the entire scope of the present invention.

Figure 1:
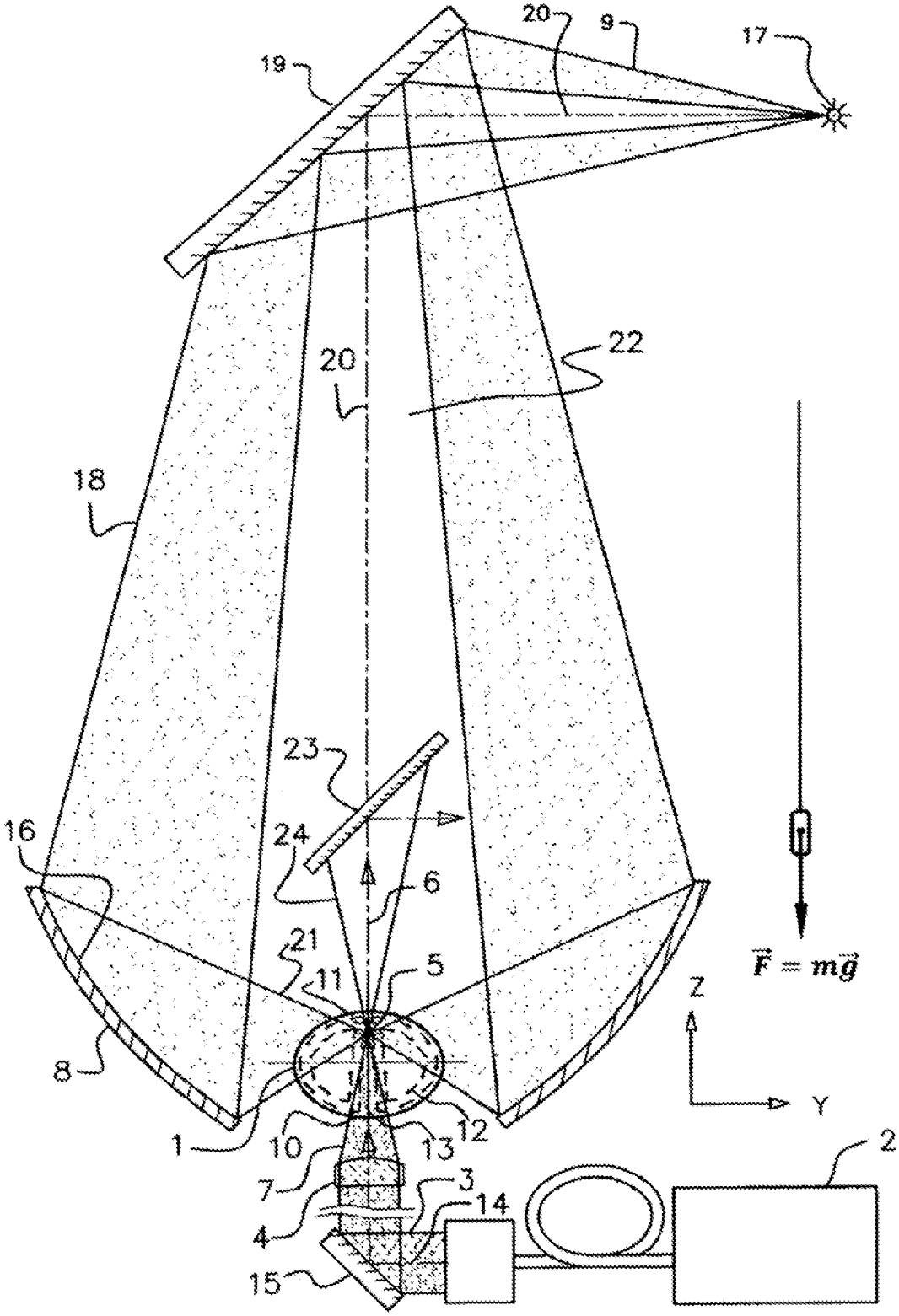

In accordance with the example of invention embodiment shown in FIG. 1, the light source with laser pumping comprises a chamber 1, containing gas; laser 2, generating a laser beam 3; optical element 4, focusing the laser beam; region of radiating plasma 5, formed in chamber 1 along the axis 6 of the focused laser beam 7; and optical system 8 for collecting plasma radiation, forming the beam of plasma radiation 9. The focused laser beam 7 is directed into the region of radiating plasma 5 from the bottom upwards: from the lower chamber wall 10 to the opposite upper wall 11 of the chamber 1. The region of radiating plasma 5 is positioned at a distance from the upper chamber wall 11 less than the distance from the region of radiating plasma 5 to the lower chamber wall 10.

On FIG. 1, as in other illustrations, the Z axis coordinate, parallel to the force of gravity $\vec{F}=m\vec{g}$ my directed vertically downwards.

When implementing in the proposed form, greatest power stability for the light source with laser pumping is attained. This is due to the fact that typically the region of radiating plasma 5 slightly shifts from the focus toward the focused laser beam 7 up to that cross section of the focused laser beam, where intensity of the focused laser beam is still sufficient for maintaining a region of radiating plasma 5. When directing the focused laser beam 7 from bottom upwards the region of radiating plasma 5, containing mostly hot and low mass density plasma, which tends to emerge under the effect of Archimedes buoyant forces. Going up, the area of radiating plasma 5 falls into a place closer to focus, where the cross section of focused laser beam 7 is smaller and the intensity of the laser radiation is greater. On one hand, this increases the brightness of plasma radiation, and on the other hand,—balances the forces, acting on the region of radiating plasma, which provides high stability of power of radiation of high brightness light source with laser pumping.

In relation to this, in preferred embodiments of the invention the axis 6 of the focused laser beam 7 directed vertically up, along the Z axis (FIG. 1), or close to the Z vertical.

Hereinafter, unless otherwise specified, closeness of objects means that the distance between the objects in the chamber 1 is many times smaller than the dimensions of chamber Another factor, affecting the stability of output characteristics of the light source with laser pumping, determined by the effect of convective streams 12 of gas in chamber 1. The created under the action of the Archimede's buoyant forces impulse of the gas, heated in the region of radiating plasma 5 the smaller, the closer the region of radiating plasma to the upper wall 11 of the chamber. In relation to this, the velocity and turbulence of convective streams 12 of gas smaller the closer the region of radiating plasma 5 is to the upper wall 11 of the chamber.

Accordingly, in preferred embodiments of the invention the region of radiating plasma 5 is located an optimally small distance h away from the upper wall 11 of chamber 1 such that there is no noticeable negative effect on the service life of the light source. It is preferable the value h is in the range from 0.5 to 7 mm.

In order so that the region of radiating plasma isn't subject to the effects of horizontal forces, caused by convective streams 12 of gas, preferably, the thermal convection in chamber 1 have an axis of symmetry, aligned with axis 6 of the focused laser beam 7.

In this regard, chamber walls 10, 11 have plane symmetry (ZY on FIG. 1), cross section of walls 10, 11 in the plane of symmetry of chamber 1 has an axis of symmetry 13, the chamber is installed such that the axis 13 of symmetry of the cross section of chamber walls 10, 11 is vertical, or close to vertical. It is preferable, for axis 6 of the focused laser beam 7 to be directed along a vertical axis 13 of symmetry of the cross section of chamber walls 10, 11 or close to the axis 13 of symmetry of the cross section of chamber walls 10, 11 and the region of radiating plasma 5 is positioned on the axis 13 of symmetry of the cross section of chamber walls 10, 11.

Deviations from the vertical axis of the focused laser beam 6, at which a significant reduction in power instability of radiation power of the light source with laser pumping is observed, are within certain limits. In relation to this, axis 6 of focused laser beam 7 creates an angle with the vertical Z, the value of which does not exceed 45 degrees.

When implementing a light source in the proposed manner its dimensions may grow vertically. Thus, to ensure device compactness the axis 14 of laser beam 3, generated by laser 2, can be directed close to the horizontal, wherein on the axis 14 of the laser beam 3, generated by laser 2, installed deflecting optical element 15, directing the axis 6 of the focused laser beam 7 upwards, towards the chamber 1. FIG. 1 shows the deflecting optical element 15 and optical element 4, focusing the laser beam, implemented as separate elements, but they can be united in one optical element, for example, a rotary focusing mirror.

In the embodiment of the invention (FIG. 1) the optical system 8 for collecting plasma radiation comprises a concave mirror 16, placed around the axis 6 of the focused laser beam 7 forming in the focus of the mirror 16 the remote light point source 17, convenient for use. Because the beam 18 of plasma radiation, reflected from the concave mirror 16, is directed mainly along the vertical, the height of the light source with laser pumping, implemented according to the invention, can become unnecessarily large.

Therefore, to ensure device compactness (FIG. 1), the light source with laser pumping comprises a deflective optical element 19 directing the axis 20 of plasma radiation beam 9 horizontally, or close to the horizontal.

As shown in FIG. 1, plasma radiation output onto the system 8 for collecting plasma radiation is performed by the beam of plasma radiation 21, exiting at large angles to axis 6 of the focused laser beam 7 and excludes spatial angles, including the axis 6 of focused laser beam 7. This in particular, determines the presence of a dark area 15 in the beam 18 of plasma radiation reflected from the concave mirror 16.

To eliminate laser radiation in the beam of plasma radiation 9 the device also contains installed from the upper wall of the chamber 1 blocker 23 of the divergent laser beam 24, passing through the region of radiating plasma 5. Blocker 23 is installed in the dark region 22 of the beam 18 of plasma radiation reflected from the concave mirror 16 (FIG. 1). Blocker 23 can be implemented as a mirror, reflecting laser radiation, or as an element which completely absorbs the radiation.

The examined inventions employ a useful effect of self-focusing the divergent laser beam 24, passing through the region of radiating plasma 5, by implementing conditions for creating a plasma lens in the region of radiating plasma 5.

Figure 2:
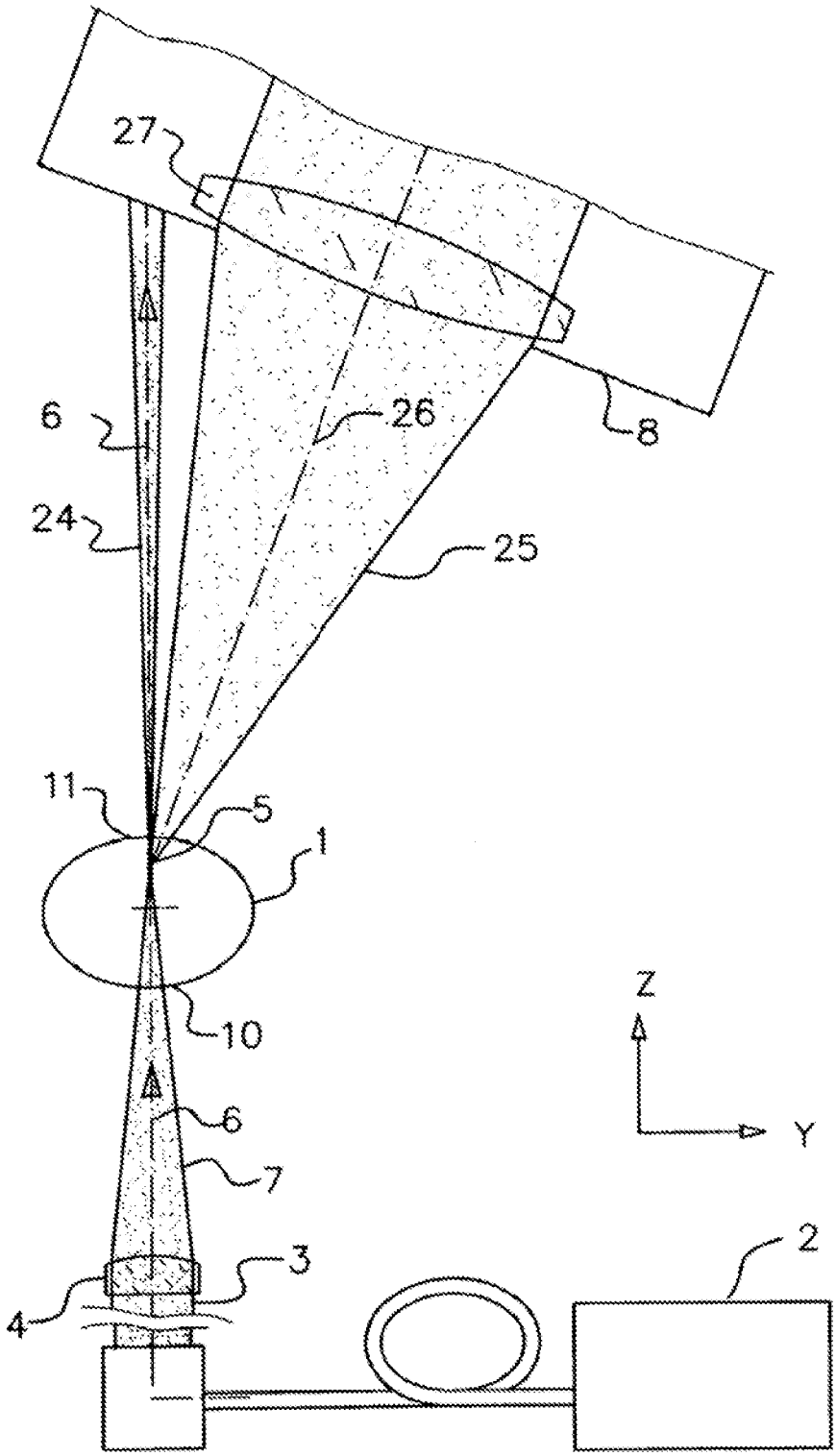

In the invention embodiment shown in FIG. 2, the numerical aperture $NA_1$ of the focused laser beam 7 and the laser power are chosen such that the region of radiating plasma 5 is long-term along the axis of the focused laser beam 7, having a small, ranging from 0.1 to 0.5, aspect ratio d/l transverse d and longitudinal l dimensions of region of radiating plasma 5. Brightness of plasma radiation in the direction along the axis of the focused laser beam 7 is close to the maximum attainable for given laser power, wherein numerical aperture $NA_2$ of the divergent laser beam 24 passing through the region of radiating plasma from the upper side of the chamber 1 is less than the numerical aperture $NA_1$ of the focused laser beam 7 from the lower side 5 of the chamber: $NA_2<NA_1$. Wherein the optical system for collecting plasma radiation is positioned from the upper side of the chamber, and plasma radiation input onto the optical system for collecting plasma radiation is carried out by divergent beam 25 of plasma radiation with apex in the region of radiating plasma 6.

Here, the numerical aperture NA of the beam is defined as $NA=n\cdot\sin\theta$, where n—the refractive index of the medium in which the beam propagates, θ—the absolute value of the angle between the edge or boundary ray of the beam and its axis. Hereinafter, n=1 and $NA=\sin\theta$. Accordingly, for the numerical aperture $NA_1$ of the focused laser beam the relation $NA_1=a/f$ is also true, where a—the radius of the laser beam upon exiting from the optical element, focusing the laser beam, f—focal distance of optical element.

The divergent beam of plasma radiation 25 with numerical aperture NA does not intersect the divergent laser beam 24 passing through the region of radiating plasma 5 from the upper side of the chamber 1, in accordance with this, the angle between the axis 26 of the divergent beam 25 of plasma radiation and axis 6 of the focused laser beam is greater than ($\mathrm{arctg}\ NA+\mathrm{arctg}\ NA_2$).

In this embodiment of the invention, along with high stability of high brightness light source with laser pumping, simplicity of design is also achieved in conjunction with reliable and simple elimination of laser radiation in the beam 25 of plasma radiation in the absence of the dark region. High brightness of radiation is provided from one side,—greater brightness of the long-term region of radiating plasma 5 along the axis 6 of the focused laser beam 7, secondly,—the close location to axis 6 of the divergent beam of plasma radiation 25.

Device brightness can be increased by locating, from the lower side of chamber 1 on axis 26 of divergent beam of plasma radiation 25, a spherical mirror, or modified concave spherical mirror with apex in the region of radiating plasma 5 (not shown for simplicity).

In the invention embodiment (FIG. 2) the optical system 8 for collecting plasma radiation comprises an input lens 27, onto which the output of plasma radiation is performed in the form of a divergent beam 25 of plasma radiation with apex in the region of radiating plasma 5. In other invention embodiments the optical system 8 for collecting plasma radiation can be more complex and contain not refractive, but reflective optics or a combination thereof.

Figure 3:
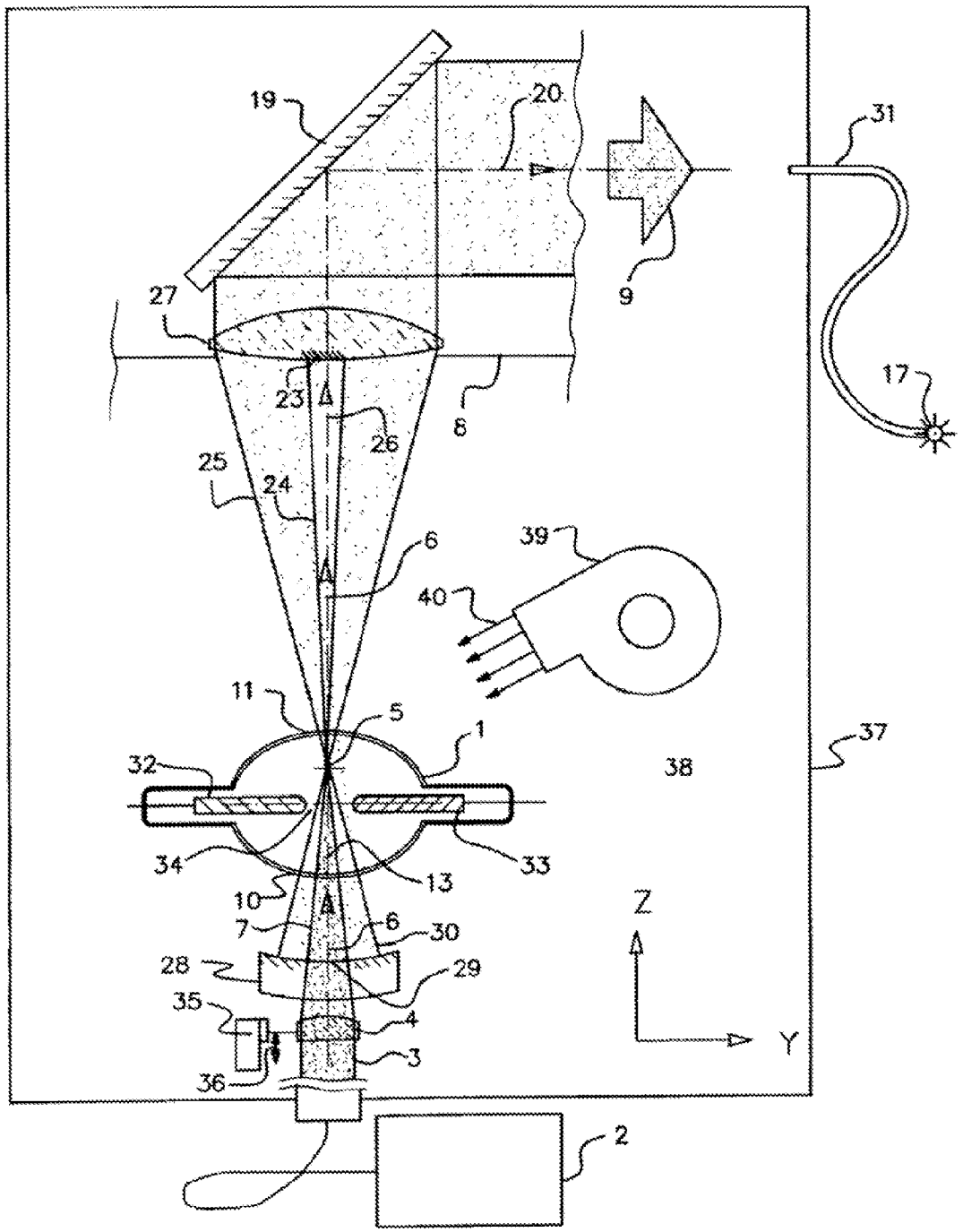

FIG. 3 shows an invention embodiment directed at the furthest improvement of output characteristics of the light source with laser pumping. The numerical aperture $NA_1$ of focused laser beam 7 and power level of laser 2 selected such that the region of radiating plasma 5 is long-term along axis 6 of the focused laser beam 7, having a small, ranging from 0.1 to 0.5, aspect ratio d/l transverse d and longitudinal l dimensions of region of radiating plasma 5, brightness of plasma radiation along the axis 6 of focused laser beam 7 close to maximum attainable for the given laser power, numerical aperture $NA_2$ of the divergent laser beam 24 passing through the region of radiating plasma 5 from the upper side of the chamber 1 is less than the numerical aperture $NA_1$ of the focused laser beam 7 from the lower side 5 of the chamber: $NA_2<NA_1$. Wherein the optical system for collecting plasma radiation is positioned from the upper side of the chamber, and plasma radiation input onto the optical system for collecting plasma radiation is carried out by divergent beam 25 of plasma radiation with apex in the region of radiating plasma 6. Additionally, axis 26 of the divergent beam 25 of plasma radiation with apex in the region of radiating plasma 5 is directed mainly along axis 6 of the focused laser beam 7.

To eliminate laser radiation in the beam of plasma radiation 9 formed by the system 8 for collecting plasma radiation, the device contains, installed from the upper side of chamber 1, a blocker 23 of divergent laser beam 24, passing through the region of radiating plasma 5. Formation of a plasma lens in the region of radiating plasma 5 and significant reduction of numerical aperture $NA_2$ of divergent laser beam 24 passing through the plasma, blocked from the upper side 11 of chamber 1, allows, when $NA_2<<NA$ for the use of simple and reliable, non-selective blockers for the small axial zone of plasma radiation beam 15, or for reflecting radiation in wide spectral range, or completely absorbing it. This can simplify the light source, ensuring reliability, high stability, and long service life. Blocker 23 can be implemented as a laser radiation-reflective coating of the small part of the surface of the output lens 27 of the optical system 8 for collecting plasma radiation (FIG. 3).

When implementing the light source with laser pumping in the proposed form with small aspect ratio d/l of the region of radiating plasma, the brightness of its radiation is maximized along axis 6 of focused laser beam 7 significantly, by several times, exceeding the brightness of the radiation in the transverse direction to the axis 6 of the focused laser beam 7. Therefore, the proposed implementation of the axial collection of plasma radiation achieves maximum source brightness, and in accordance with the invariance principle, the brightness is transported without changes or losses by the optical system. Thus, the self-focusing of the divergent laser beam 24 that passed through the region of radiating plasma 5 simplifies its blocking without significant losses in the divergent beam of plasma radiation 25.

The effectiveness of the system for collecting radiation is increased, if from the bottom side of chamber 1 a concave spherical mirror 28 is installed, with center in the region of radiating plasma 5, having an opening 29 for input of focused laser beam 7 into the region of radiating plasma 5.

In this embodiment of the invention the beam 25 of plasma radiation is enhanced by the beam 30 of plasma radiation, reflected from the spherical mirror 28, installed from the lower side of chamber 1, with center in the region of radiating plasma 5. This permits increasing the brightness in the beam 25 of plasma radiation, significantly increasing the effectiveness of the system of collecting plasma radiation and increasing the effectiveness of the light source as a whole. According to the experiment, the increase of brightness and collection effectiveness comprises about 70%.

The concave spherical mirror 28 is transparent to the focused laser beam 7 near its axis 6 and has optical opening 29. This embodiment of the invention simplifies the design of the concave spherical mirror 28.

From the lower side of the chamber a concave modified spherical mirror 28 is installed, with center in the region of radiating plasma 5, having opening 29, in particular, an optical opening, for input of focused laser beam 7 into the region of radiating plasma 5. Using a modified spherical mirror 28 is preferred to compensate for the distortion of optical rays due to chamber 1 walls, which increases the effectiveness of the light source with laser pumping.

In this embodiment of the invention, shown in FIG. 3, the optical system 8 for collecting plasma radiation forms a beam of plasma radiation 9, inputted into the optical fiber 31, which, while transporting the plasma radiation, provides a high brightness remote light point source 17 in the location needed for use.

Two electrodes 32, 33 are placed in chamber 1 for starting plasma ignition with discharge gap 34 between them. Their use simplifies plasma ignition, maintained afterwards in continuous mode using a laser. In certain cases the power density of the laser radiation in the chamber is insufficient to plasma ignition, therefore use of electrodes 32, 33 for starting plasma ignition is a necessary condition for creating the region of radiating plasma 5.

Preferably, the longitudinal axes of electrodes 32, 33 for starting plasma ignition are horizontal. This simplifies the arrangement of chamber 1 such that the axis 13 of symmetry of the cross section of chamber walls is vertical, which increases stability of plasma radiation.

To simplify chamber 1 design the region of radiating plasma 5 is positioned outside the discharge gap 34. To simplify starting of plasma ignition it is preferable the optical element 4, focusing the laser beam, be implemented with function for short-term displacements of the focus of the laser beam 7 in the discharge gap 33 during the time of starting plasma ignition. With this goal, in one of the embodiments of the invention the optical element 4, focusing the laser beam, can be installed from the controllable linear translator 35 (FIG. 3), repositioned in the directions denoted by arrows 36. In another embodiment of the invention the optical element 4, focusing the laser beam, can be made in the form of a lens with variable focal length.

To eliminate ozone formation the chamber 1 is placed in a seal housing 37, and the sealed housing 37 filled with protective gas 38. Gas that does not contain oxygen, such as nitrogen, can be used as a protective gas.

To maintain the permitted temperature of the upper wall 11 necessary for long term chamber 1 operation, a fan 39 is placed in chamber 1. Preferably, the gas flow 40 of protective gas, created by the fan 39 directed toward the upper wall 11 of chamber 1, close to which the region of hot radiating plasma is formed. Therefore it is preferable that the wall or walls of the sealed housing 37 are implemented as radiators, performing high-efficiency heat exchange with the air surrounding the housing 37.

Figure 4:
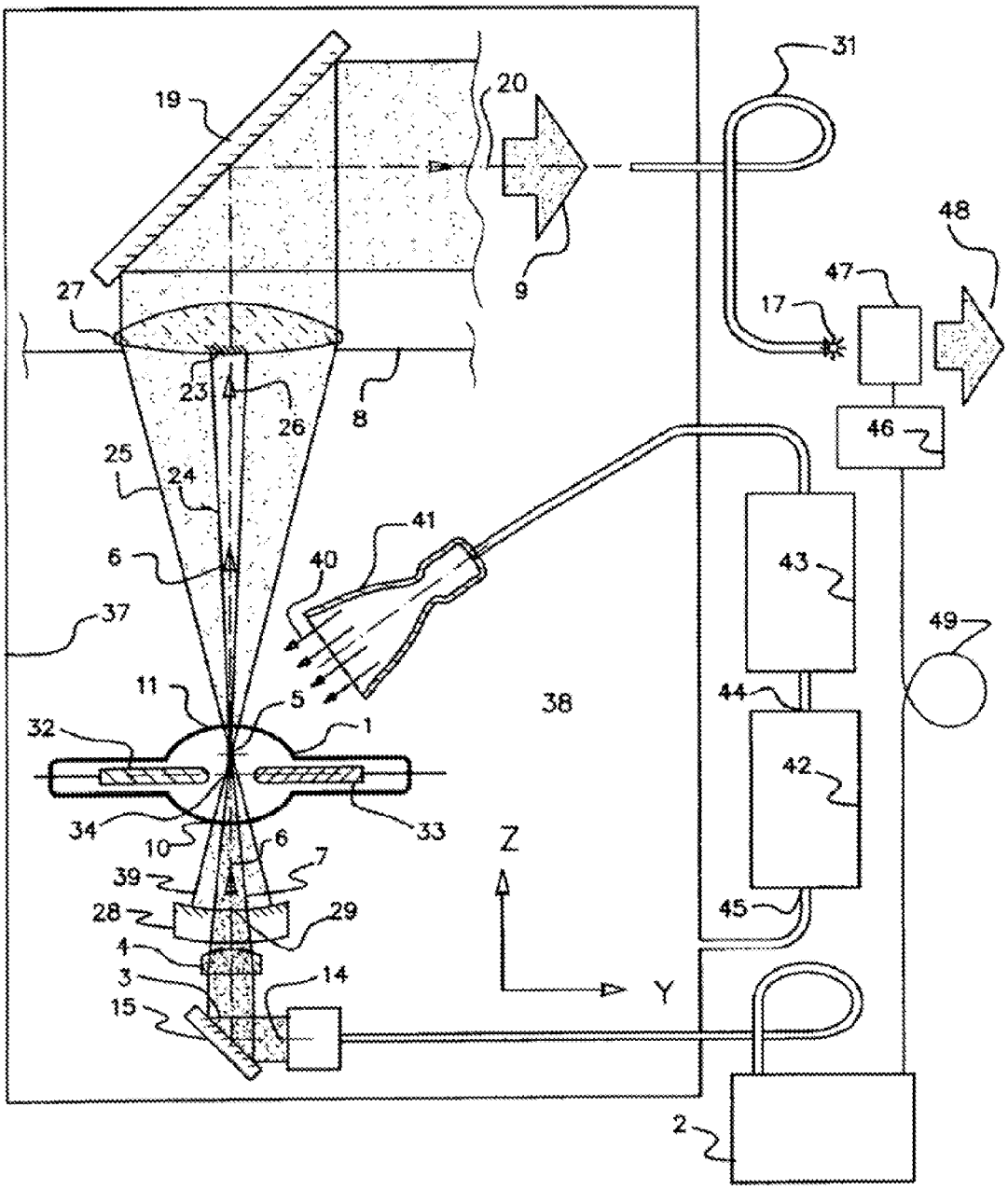

FIG. 4 illustrates an embodiment of the invention where in order to organize the protective gas flow and more effectively cool chamber 1, a system is implemented for circulating protective gas in the sealed housing 37, containing at least one nozzle 41, providing blowing of chamber 1 by the flow 40 of protective gas, mini-compressor 42 and heat exchanger 43. Thus, the outlet 44 of mini compressor 42 is connected to the nozzle 41, through the heat exchanger 43, and the inlet 45 of mini-compressor 42 is connected to sealed housing 37.

The device can be fitted with an automated control system (ACS) for the light source with laser pumping, characterized by negative feedback between the power level of plasma radiation beam and laser power. ACS includes a controller 46, controlling laser 2 output power, on the basis of the results of data processing by plasma radiation power meter 47. Preferably, the measurement device 47 for plasma radiation power is installed after the optical fiber 31, providing, at the output, a remote light point source 17 in the place necessary for forming the final plasma radiation beam 48. Preferably, the plasma radiation power meter 47 is aligned with the optical block for forming the final plasma radiation beam, wherein a splitter is installed, branching a small part of plasma radiation beam power on power meter 47 photodetector (photodiode). Controller 46 is connected to the inlet for laser 2 control block by, for example, optical fiber 49. Using the ACS allows maintaining the specified, stabilized light source power level in long-term mode or changing it with time according to a given program. The ACS for light source with laser pumping can include control and monitoring systems for laser 2 temperature, protective gas in chamber 37, chamber 1 walls.

Figure 5:
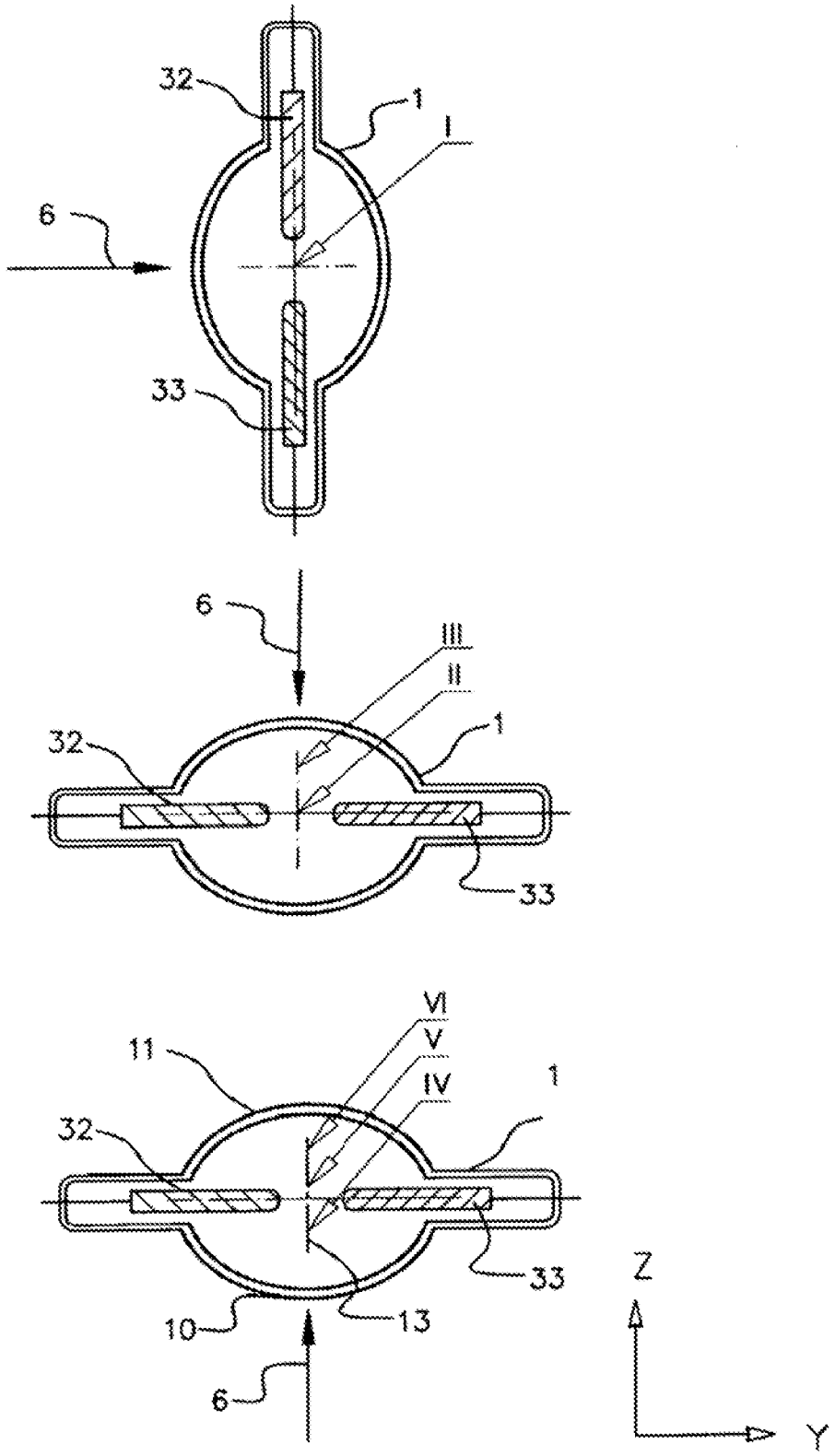
FIG. 5 shows various configurations of the light source with laser pumping, differing in the level of instability of the plasma radiation power.

FIG. 5 shows various configurations for light sources with laser pumping, differing in the direction of the axis 6 of the focused laser beam, orientation of electrodes 32, 33 for starting plasma ignition and various positions I-VI of the region of radiating plasma along axis 6 of focused laser beam 7, and differing, correspondingly, in the power instability of the light source radiation 3σ. Here 3σ—standard deviation of radiation power I of light source with laser pumping determines the interval ($\bar{I}/I-3\sigma$; $\bar{I}/I+3\sigma$) near average value $\bar{I}$, wherein power measurement values of light source with laser pumping have 99.7% confidence. Averaging of light source radiation power I was performed in 0.1 second time intervals.

Table 1 shows measured values 3σ—standard deviation of radiation power for configurations of laser-pumped light source with various positions I-VI of regions of radiating plasma shown in FIG. 5.

TABLE 1

Measured standard deviation of plasma radiation power for various configurations of light sources with laser pumping.

| | Configuration of light sources with laser pumping (FIG. 5) | | | | | |
|---|---|---|---|---|---|---|
| | I | II | III | IV | V | VI |
| 3σ- standard deviation of radiation power, % | 0.6 | >2 | 0.67 | 0.38 | 0.09 | 0.06 |

Plasma was created in lamp "OSRAM" XBO 150 W/4, filled with Xe at a pressure of 20 atm. For laser pumping, ytterbium laser YLPM-1-A4-20-20 IPG IRE-Polus with 125

W of radiation power at radiation wavelength $\lambda$=1070 nm was used. Laser radiation power density was insufficient for plasma ignition, therefore two probe electrodes 32, 33 are used for starting plasma ignition. From table 1 data, it is clear that, depending on the configuration of light source with laser pumping, the instability of radiated power changes by over an order of magnitude.

Similar results were obtained when using a laser with radiation wavelength 980 nm.

According to the measurement results, the highest radiation power stability was achieved for configuration VI for light source with laser pumping, implemented according to the present invention. In this configuration:

Axis 6 of focused laser beam 7 is directed into the region of radiating plasma 5 vertically from the bottom upwards, Region of radiating plasma 5 is positioned, as shown by arrow VI, at a smaller distance from the upper wall 11 of the chamber than the distance between the region of radiating plasma 5 and the lower wall 10 of the chamber, Region of radiating plasma 5 is positioned at an optimally small distance away from the upper wall 11 of the chamber 1 which does not have any noticeable negative impact on the service life of the light source with laser pumping;

Walls 10, 11 of the chamber are symmetrical relative to the vertical ZY plane; in vertical ZY plane of symmetry the cross sections of walls 10, 11 of chamber 1 are symmetrical relative to the vertical axis 13; axis 6 of focused laser beam is directed along the vertical axis 13 of symmetry of cross sections of walls 10, 11 of chamber 1, Region of radiating plasma is produced outside the discharge gap 34, located between two electrodes 32, 33 for starting plasma ignition; axes of electrodes 32, 33 for starting plasma ignition are horizontal.

Method for generating radiation, primarily broadband high brightness radiation using light source with laser pumping, illustrated in FIG. 1, is implemented as follows. Turn on laser 2, providing laser beam 3. Ignite plasma in chamber 1, containing gas, in particular, Xe at high, 10-20 atm, pressure. Optical element 4, focuses laser beam 7 into chamber 1. In chamber 1, using focused laser beam 7, region of radiating plasma 5 is produced on axis 6 of focused laser beam 7 and provides continuous laser power input into the region of radiating plasma 5 to maintain high brightness plasma radiation in continuous mode. Focused laser beam 7 is directed into region of radiating plasma 5 from bottom upwards: from lower wall 10 of chamber 1 to opposing upper wall 11 of chamber 1 such that region of radiating plasma 5 is positioned at a smaller distance from the upper wall 11 of chamber 1 than the distance between the region of radiating plasma 5 and the lower wall 10 of chamber 1. In addition, collection of plasma radiation is performed by system 8 for collecting plasma radiation, which is used to form beam of plasma radiation 9.

In the preferred embodiments of the invention axis 6 of focused laser beam 7 is directed upward along a vertical, along axis Z, or close to vertical. Focused laser beam 7 is directed into chamber 1 along vertical axis 13 of symmetry of cross sections of walls 10, 11 of chamber 1. Region of radiating plasma 5 is produced at an optimally small distance away from the upper wall 11 of the chamber 1 which does not have any noticeable impact on the service life of the light source. Focused laser beam 7 is directed into chamber 1 such that the axis 6 of focused laser beam 7 makes an angle to the vertical (Z), the value of which does not exceed 45 degrees. Laser beam 3, generated by laser 2, having a direction close to horizontal, is deflected upwards in the direction of chamber 1 using deflecting optical element 15, installed from the axis of laser beam 3, generated by laser 2.

In the embodiment of the invention (FIG. 1), output of plasma radiation on optical system 8 for collecting plasma radiation is carried out by plasma radiation beam 21 exiting at large angles to axis 6 of focused laser beam 7 and eliminating spatial angles on the axis 6 of focused laser beam 7 with overall center in the region of radiating plasma. Collection of plasma radiation is carried out by optical system 8, comprising a concave mirror 16, positioned around axis 6 of focused laser beam 7. In the focus of the concave mirror 16 form a remote light point source 17. This, in particular, determines the presence of dark region 15 in beam 18 of plasma radiation reflected from concave mirror 16.

During formation of plasma radiation beam 9 the presence of laser radiation within is eliminated by the installed from upper side of chamber 1 blocker 23 of divergent laser beam 24 that passed through region of radiating plasma 5. Blocker 23, which can be installed in the dark region 22 of plasma radiation beam 18 reflected from concave mirror 16, absorbs laser 2 radiation or reflects it to the side against plasma radiation beam 9. Axis 20 of plasma radiation beam 9, formed by optical system 8 for collecting plasma radiation, is directed along the horizontal, or close to horizontally using optical element 19, installed on axis 20 of plasma radiation beam, which ensures device compactness.

By selecting the laser 2 power and numerical aperture $NA_1$ of focused laser beam 7 in chamber 1, a region of radiating plasma is formed extending along axis 6 of the focused laser beam, characterized by:

- small aspect ratio d/l transverse d and longitudinal l dimensions, ranging from 0.1-0.5,
- plasma radiation brightness along axis 6 of the focused laser beam close to maximum possible for given laser 2 power,
- features of plasma lens, providing a reduction in numerical aperture $NA_2$ of divergent laser beam 24 that passed through plasma from the upper side of chamber 1 when compared to numerical aperture $NA_1$ of focused laser beam 7 from the lower side of chamber: $NA_2<NA_1$.

Additionally, output of plasma radiation on the optical system 8 for collecting plasma radiation positioned on the upper side of chamber 1 is carried out by divergent plasma radiation beam 15 with apex in the region of radiating plasma.

In the embodiment of the invention (FIG. 2) output of plasma radiation on the optical system is carried out by divergent plasma radiation beam, not crossing the divergent laser beam that passed through the region of radiation plasma; in accordance with this the angle between the axis of the divergent beam of radiating plasma, characterized by numerical aperture NA, and the axis of the focused laser beam is greater than (arctg NA+arctg $NA_2$).

In preferred embodiments of the invention (FIG. 3, FIG. 4) output of plasma radiation onto optical system 8 for collecting plasma radiation is carried out by divergent plasma radiation beam 13, optical axis 17 direction mainly coinciding with the direction of axis 6 of focused laser beam 7. Collection of plasma radiation is carried out by optical system 8, including an input lens 27. Using blocker 23, the propagation of divergent laser beam 24 that passed through the region of radiating plasma, along the optical system 8 for collecting plasma radiation 5 is prevented. The blocker can be implemented as a reflective, in particular, selectively reflective of the laser beam, coating on input lens 27. In the latter case, formation of the plasma radiation beam 9 by the optical system for collecting plasma radiation 8 does not have shaded zones.

In invention embodiments (FIG. 3, FIG. 4) using optical system 8 for collecting plasma radiation, the plasma radiation beam 9 is formed, which is inputted into the optical fiber 31, providing high brightness of the remote light point source for use in the necessary place.

Focused laser beam 7 is directed from bottom upwards: from lower wall 10 of chamber 1 to the opposite upper wall 11 of chamber 1, temporarily focusing laser beam 7 in discharge gap 34 between electrodes 32, 33 for starting plasma ignition, plasma ignition is started and the focus of laser beam 7 is redirected from bottom upwards and the focused laser beam 7, in continuous mode, forms the region of radiating plasma 5 outside the discharge gap 34 near the upper wall 11 of chamber 1. Plasma ignition is preferably carried out between probe electrodes 32, 33 for starting plasma ignition, whose axes are horizontal. Additionally, optical element 4 for focusing the laser beam is implemented with the function for short-term displacements of the focus of laser beam 7 in the discharge gap 34 during the time plasma ignition starts. Optical element 4, focusing the laser beam, is repositioned in the directions shown with arrows 36 (FIG. 3) using the controllable linear translator 35. In another embodiment of the invention the focus of laser beam 7 is displaced by implementing the optical element 4, focusing the laser beam, as a lens with variable focal length.

Flow 40 of protective gas is directed towards the upper wall 11 of chamber 1. Wherein the stream 40 of protective gas is produced, separate from air, by fan 39. In preferred embodiments chamber 1 and the fan are placed in the sealed housing 37.

In other cases stream 40 of protective gas is directed towards upper wall 11 of chamber 1 using, at least, one nozzle 41, to which outlet 44 of mini-compressor 42 (FIG. 4) is connected. In preferred embodiments blowing the upper wall 11 of chamber 1 is performed by directing stream 40 of protective gas, produced using a system for circulating protective gas, comprising at least one nozzle 41, mini-compressor 42 and heat exchanger 43. Preferably, the outlet 44 of mini compressor 42 is connected to nozzle 41 via heat exchanger 43, and mini compressor 42 inlet 45 is connected to sealed housing 37.

Preliminarily a required value of the radiation power of the light source with laser pumping is pre-set and during long-term operation the maintenance of a predetermined radiation power of the light source with laser pumping is provided using the automated control system with negative feedback. During ACS operations controller 46 determines, based on power meter 47 data, the power difference of the output beam 48 of plasma radiation from the pre-set level and processes the control signal, sent, for example, along optical fiber 49 at input of laser 2 control block. Using ACS provides preprogrammed temporal behaviors of radiation power from light source with laser pumping.

When implemented in the proposed form, the light source with laser pumping acquires new positive qualities.

In the proposed input of focused laser beam 7 into region of radiating plasma 5 from bottom upwards, preferably vertically, with region of radiating plasma 5 formed near upper wall 11 of chamber 1 is achieved highest radiation power stability of light source with laser pumping. The positive effect is due to the movement of region of radiating plasma from focus downward towards focused laser beam 7 up to the cross section where laser intensity is still sufficient for maintaining the region of radiating plasma being balanced by floating of region of radiating plasma 5. Floating of the region of radiating plasma 5, containing a very hot and low mass density plasma, occurs under the influence of Archimedes force. As a result, region of radiating plasma 5 is positioned in a place close to focus, where the cross section of focused laser beam 7 is smaller and laser radiation intensity is higher. On one side, this increases plasma radiation brightness, on the other side,—due to balance of forces, acting on the region of radiating plasma, it ensures higher radiation power stability of the high brightness light source with laser pumping.

As a result, light source brightness is greatly increased and the radiation power instability of light source with laser pumping is reduced significantly by up to orders of magnitude.

The closer to the upper wall 11 of the chamber the region of radiating plasma, wherein the main heat release occurs, the lower the thrust, and consequently, lower velocity and turbulence of convective streams 12 of gas in the chamber. This increases stability of output characteristics of the light source with laser pumping when, as proposed, the region of radiating plasma is placed at the minimal distance to the upper wall 11 of the chamber 1 necessary to avoid causing significant negative effects on the service life of the light source.

Placing chamber 1 in sealed housing 37, filled with protective gas 38 eliminates ozone formation.

Cooling the upper wall 11 of chamber 1 with flow of protective gas 40 using fan 39 or, which is more effective, using a system for circulating gas in sealed housing 37 maintains the temperature of the heated upper wall 11 of chamber 1 at a level necessary for providing large service life of the light source. In the same way, effective cooling of chamber 1 allows increasing laser pumping power and, consequently, increasing light source brightness.

Inclination of axis 6 of focused laser beam from the vertical Z by a value, not exceeding 45 degrees, allows reduction, for the specified reasons, of radiation power instability of light sources with laser pumping.

Forming region of radiating plasma, long-term along the axis of the focused laser beam, with small aspect ratio d/l, features of a plasma lens ($NA_2<NA_1$) and plasma radiation brightness along the axis of the focused laser beam close to maximum attainable for given laser power, determines the following primary benefits.

The greatest benefits are achieved at output of plasma radiation on the optical system 8 for collecting plasma radiation, positioned from the upper wall of the chamber, by divergent plasma radiation beam 25, directed along axis 26 which mainly coincides with the direction of axis 6 of focused laser beam 7 (FIG. 3, FIG. 4). For the region of radiating plasma 5, beneficially transparent to its own radiation, the greatest brightness is with a small, from 0.1 to 0.5, aspect ratio d/l implemented in the direction along axis 6 of focused laser beam 7. Choosing the optimal numerical aperture $NA_1$ of focused laser beam 7 for each selected laser power value at which high-effective operation of the device can occur, ensures close to maximum possible brightness of plasma radiation specifically in the direction of axis 6 of focused laser beam 7. The maximum brightness of light source with laser pumping achieved in this way is transferred by optical system for collecting 8 plasma radiation, performing radiation collection in the axial direction (FIG. 3, FIG. 4). This determines the obtainment of significantly higher brightness in the light source, implemented according to the present invention, compared to light source (FIG. 1) configurations, using off-axis plasma radiation collection. Additionally, high effectiveness of plasma radiation collection is achieved by choosing the numerical aperture value for plasma radiation beam NA, meeting the conditions NA≥d/l. Forming the region of radiating plasma with features of a plasma lens is, according to experimental data, is one of the conditions for effective device operation. Additionally, there is a significant reduction of numerical aperture $NA_2$ of divergent laser beam, that passed through the region of radiating plasma, and at $NA_2 << NA$ a blocker can be used, shading only a very small axial zone of divergent plasma radiation beam 25. In this case, simple and reliable blockers can be used, or those reflective of radiation in a wide spectral range, or completely absorbent. This simplifies the light source, providing reliability, high stability, and long lifetime. Enhancing divergent plasma radiation beam 25 using radiation plasma beam 39, reflected from spherical mirror 28 or modified mirror, installed from the lower side of chamber (FIG. 3, FIG. 4), significantly increases, by 70% according to experimental data, the effectiveness of plasma radiation collection and efficiency of light sources with laser pumping as a whole. Output on optical system 8 for collecting plasma radiation from divergent plasma radiation beam 25, not crossing divergent laser beam 24 that passed through the region of radiating plasma, ensures device simplicity and reliability (FIG. 2). Along with high stability of high brightness light source with laser pumping, reliable and simple elimination of laser radiation in plasma radiation beam 25 is ensured at the absence of shaded regions. High brightness radiation is provided, on one hand, greater brightness of elongated region of radiating plasma 5 along the axis 6 of focused laser beam 7, secondly,—positioning divergent plasma radiation beam 25 close to this axis. Using electrodes 32, 33 for starting plasma ignition, then sustaining it in continuous mode using laser 2 simplifies plasma ignition. When horizontally positioning longitudinal axes of electrodes 32, 33 the ability to position the chamber with vertical axis 13 of symmetry of walls 10, 11 is simplified, increasing plasma radiation stability.

Producing the region of radiating plasma 5 outside the discharge gap 34 simplifies the design of chamber 1 for light source with laser pumping implemented according to the invention. In this implementation of optical element 4, focusing laser beam, with the function for short-term displacements of the focus of laser beam 7 in the discharge gap 34 provides reliable starting ignition of the plasma.

Using the ACS it is possible to maintain the specified, stabilized light source power level in long-term mode, as well as control the radiated power of the device in programmed mode.

Therefore, the present invention can significantly increase spatial and energy stability of a broadband light sources with laser as well as increase brightness while ensuring compactness and simplicity of design, reliable prevention of unwanted laser radiation from getting into the system for collecting plasma radiation. All this expands the functional capabilities of the device.

INDUSTRIAL APPLICABILITY

Implemented according the present inventions, high-brightness high-stability light sources with laser pumping can be used in various projection systems, for spectro-chemical analysis, spectral microanalysis of bioobjects in biology and medicine, in microcapillary liquid chromatography, for inspecting optical lithography process, for spectrophotometry and other uses.

What is claimed is:

1. A light source with a laser pumping, comprising: a gas filled chamber (1); laser (2) for generating a laser beam (3); an optical element (4), focusing the laser beam; a region of radiating plasma (5) created in the chamber (1) on an axis (6) of a focused laser beam (7); and an optical system (8) for collecting plasma radiation and forming a plasma radiation beam (9), in which the focused laser beam (7) is directed into the region of radiating plasma (5)) from a bottom upwards: from a bottom wall (10) of the chamber (1) to an opposite top wall (11) of the chamber (1), and the region of radiating plasma (5) is positioned at a. distance from the top wall (11) of the chamber (1), which is less than a distance from the region of radiating plasma (5) to the bottom wall (10) of the chamber (1).

2. The light source according, to claim 1, wherein the axis (6) of the focused laser beam (7) is directed upwards along, a vertical (Z) or close to vertical.

3. The light source according to claim 1. wherein the region of radiating plasma (5) is positioned at a minimal distance from the top wall (11) of the chamber (1) to avoid causing significant negative effects on the lifetime of the light source with laser pumping.

4. The light source according to claim 1, wherein the chamber walls (10, 11) have a plane of symmetry (ZY) with an axis (13) of symmetry of the walls (10, it) of a chamber (1) cross section in symmeny plain (ZY), the chamber (1) is positional in such a way that the axis (13) of symmetry of the cross section of the walls (10, 11) of the chamber (1) is vertical, or dose to vertical.

5. The light source according to claim 4, wherein the axis (6) of the focused laser beam (7) is directed along the axis (13) of symmetry of the cross section of the walls (10, 11) of the chamber (1).

6. The light source according to claim 1, wherein the axis (6) of the focused laser beam (7) forms an angle with a vertical (Z), the angle not to exceed 45 degrees.

7. The light source according to claim 1, wherein, from a lower side of the chamber (1), an axis (14) of the laser beam (3), generated by the laser (2), has a direction, close to horizontal, wherein on the axis (14) of laser beam (3) an optical element. (15) is mounted, directing the laser beam (3) in a direction of the chamber (1).

8. The light source according to claim 1, further comprising an optical element (19), directing an axis (20) of the plasma radiation beam (9) along a horizontal line, or close to horizontally.

9. The light source according to claim 1. wherein a numerical aperture $NA_1$ of the focused laser beam (7) and a laser (2) power selected such that the region of radiating plasma (5) is prolonged along the axis (6) of the focused laser beam (7), has a small, ranging from 0.1 to 0.5, aspect ratio d/l of a transverse d and a longitudinal l dimensions of the region of radiating plasma (5), a plasma radiation brightness along the axis (6) of the focused laser beat (7) is close to maximum attainable for the given laser (2) power, a numerical aperture $NA_2$ of a divergent laser beam (24) passing through the region of radiating plasma (5) from an upper side of the chamber (1) is less than the numerical, aperture $NA_1$ of the focused laser beam (7) from a lower side of the chamber (1): $NA_2 < NA_1$, wherein the optical system (8) for collecting plasma radiation is positioned on the upper side of the chamber (1), and an output of plasma radiation onto the optical system (8) for collecting plasma radiation is carried out by a divergent beam (25) of plasma radiation with an apex in the region of radiating plasma (5).

10. The light source according to claim 9, wherein, the divergent beam (25) of plasma radiation with the numerical aperture NA, entering onto the optical system. (8) for collecting plasma radiation, does not intersect the divergent laser beam (24) from the upper side of the chamber (1) that has passed through the region of radiating plasma; in accordance with this, an angle between the axis (26) of the divergent beam of plasma radiation (25) and the axis (6) of the focused laser beam is greater than (arctg NA+arctg $NA_2$).

11. The light source according to claim 9, wherein the axis of divergent beam of plasma radiation (25) outputting onto the optical system (8) for collecting plasma radiation is directed primarily along the axis (6) of the focused laser beam.

12. The light source according to claim 9, wherein, installed from the lower side of the chamber, a concave spherical mirror (28) or modified concave spherical mirror (28) with a center in the region of the radiating plasma (5), having an opening (29), in particular, optical opening, for an input of the focused laser beam (7) in the region of radiating plasma (5).

13. The light source according to claim 1 wherein two probe electrodes (32),(33) are inserted in the chamber (1) for starting ignition of plasma, the electrodes having horizontal longitudinal axes.

14. The light source according to claim 1, wherein two electrodes (32),(33) for starting ignition of plasma are placed in the chamber (1) with a discharge gap (34) between them, the region (5) of radiating plasma is positioned outside the discharge gap (34), wherein the optical element (4) focusing the laser beam (7), is implemented with function for short-term displacements of a focus of the laser beam (7) in the discharge gap (34) for duration of starting plasma ignition.

15. The light source according to claim 1, wherein the chamber (1) is located in a sealed housing (37) with a protective gas (38), and a system for circulating the protective gas in housing (37) is added.

16. The light source according to claim 1, wherein an automated control system with a negative feedback is introduced and has a function for maintaining a specified power of the light source with the laser pumping, including a power meter (47) for plasma radiation beam and a controller (46) processing power meter measurement data of the plasma radiation beam and controlling an output power of the laser (2).

17. A method for generating radiation, comprising: directing a focused laser beam (7) from bottom upwards: from a bottom wall (10) of a chamber (1) to an opposite top wall (11) of the chamber (I), temporarily providing focusing of the laser beam (7) in a discharge gap (34) between electrodes (32), (33) for starting plasma ignition; igniting plasma and shifting a focus of the laser beam (7) from bottom upwards and using the focused laser beam (7) in continuous mode forming a region of radiating plasma (5) outside the discharge gap (34) near the top wall (11) of the chamber (1) thus generating, radiation from a light source comprising all above elements.

18. The method for generating radiation according to claim 17, wherein the focused laser beam (7) is directed into the chamber (1) along a vertical axis (13) of symmetry of cross sections of the walls (10), (11) of the chamber (1) and the region of radiating plasma (5) is produced at an optimally small distance away from the top wall (11) of the chamber (1) which does not have any negative impact on the lifetime of the light source for generating radiation.

19. The method for generating radiation according to claim 17, wherein the chamber (1) is cooled with a flow (40) of protective gas, directed towards the top wall (11) of the chamber (1).

20. The method for generating radiation according to claim 17, wherein required radiation power value for the light source with laser pumping is preliminarily set and during long-term operations, with an aid of an automated control system (46, 47, 49), a set radiated power for the light source with laser pumping is maintained.

* * * * *